US005673461A

United States Patent [19]

Sramek

[11] Patent Number: 5,673,461

[45] Date of Patent: Oct. 7, 1997

[54] METHOD OF, AND DEVICE FOR, DEPOSITING A TEXTILE FIBER SLIVER INTO A FLAT SLIVER CAN

[75] Inventor: Rudolf Sramek, Liberec, Czech Rep.

[73] Assignee: Výzkumný Ústav Textilních Strojú Liberec A.S., Czech Rep.

[21] Appl. No.: 572,527

[22] Filed: Dec. 14, 1995

[51] Int. Cl.[6] ..... D01G 27/00

[52] U.S. Cl. ..... 19/159 R

[58] Field of Search ..... 19/159 R, 159 A; 100/82; 57/281; 220/751

[56] References Cited

U.S. PATENT DOCUMENTS

| | | | |
|---|---|---|---|
| 2,959,279 | 11/1960 | Kraft et al. | 19/159 R X |
| 3,052,010 | 9/1962 | Martin | 19/159 R X |
| 3,081,511 | 3/1963 | Suggs et al. | 19/159 R X |
| 3,135,038 | 6/1964 | Pflugrad | 19/159 R X |
| 5,333,359 | 8/1994 | Kroupa | 19/159 R |
| 5,428,869 | 7/1995 | Holubec et al. | 19/159 R |

FOREIGN PATENT DOCUMENTS

| | | | |
|---|---|---|---|
| 251650 | 4/1988 | Czech Rep. . | |
| 0340459 | 11/1989 | European Pat. Off. . | |
| 2048321 | 12/1980 | United Kingdom | 19/159 R |

*Primary Examiner*—Ismael Izaguirre

*Attorney, Agent, or Firm*—Ostrolenk, Faber, Gerb & Soffen, LLP

[57] ABSTRACT

A method of depositing a textile fiber sliver into flat sliver cans. The sliver is deposited in layers of loops similar in shape to cycloids produced under the action of an inner force effect of the sliver body in the flat sliver can. The force results from the combination of the rotary motion of an outlet aperture of the can coiler and of the mutual reversing rectilinear motion of the can coiler and of the flat sliver can in the direction of the longitudinal axis of the flat sliver can. The axis of rotation of the can coiler lies in the longitudinal axis of the flat sliver can. The width of the layers of the loops in the direction perpendicular to the longitudinal axis of the flat sliver can is inferior to the width of the inner space of the flat sliver can. Thus, a deflection is produced of the sliver loop towards the longitudinal walls of the flat sliver can at which there is a greater velocity of the mutual relative motion of the outlet aperture of the can coiler and of the flat sliver can.

8 Claims, 4 Drawing Sheets

METHOD OF, AND DEVICE FOR, DEPOSITING A TEXTILE FIBER SLIVER INTO A FLAT SLIVER CAN

TECHNICAL FIELD

The invention relates to a method of, and device for, depositing a textile fibre sliver into a flat sliver can in which the sliver is deposited in loops produced by the combination of the mutual reversing rectilinear motion of a can coiler and of the flat sliver can in the direction of the longitudinal axis of the flat sliver can, and of the rotary motion of the outlet aperture of the can coiler whose axis of rotation lies in the longitudinal axis of the flat sliver can.

BACKGROUND OF THE INVENTION

In the textile industry, the sliver producing machines use for depositing the sliver containers called sliver cans and serving also to feed the sliver to a sliver processing machine. The cylindrical sliver cans, most common up to now, have now begun to be replaced by .flat cans shaped in plan view as a rectangle with either rounded corners or with shorter sides shaped in cross section as a circle or otherwise rounded.

The sliver is deposited into said flat sliver cans in several ways, each of which, however, is a combination of the rotary motion of the can coiler or, more specifically, of its outlet aperture, with the mutual reversing rectilinear motion of the flat sliver can and of the can coiler. The combination of these two motion produces the deposition of the sliver into the flat sliver can in the shape of a loop having ideally the form of cycloids continuously deposited next to each other and creating over the bottom of the flat sliver can loop layers with each layer being deposited on the preceding one in the reversed direction of the reversing rectilinear motion. The width of the sliver loops corresponds to the width of the inner space of the flat sliver can.

In this way, the sliver is deposited into flat sliver cans, for instance, in EP 340459 A1 or in CS PV 3068-92, differing from each other only in that the reversing rectilinear motion is carried out, in EP 340459 A1, by the flat sliver can under the rotating can coiler, while in CS PV 3068-92, by the rotating can coiler over the flat sliver can.

The drawback of this method of the sliver deposition consists in the fact that the density of the deposited sliver is near the walls of the flat sliver can sensibly greater that in the central section of the flat sliver can which is adverse to the requirement of filling sliver cans with as much sliver as possible.

This drawback has been eliminated in the CS AO 251 650 in which the sliver is deposited in narrow loop rows put in one layer next to each other. Each sliver loop row is produced in one operation along the whole length of the flat sliver can so that the neigbouring loop rows are produced at the mutually opposite direction of the reversing rectilinear motion of the flat sliver can, and the displacement from one loop row to the next one is provided for by an additional motion of the flat sliver can.

This system is applicable also in the devices in which the reversing rectilinear motion is carried out by the can coiler over the flat sliver can; the additional motion can be then carried out either by the can coiler or by the flat sliver can.

The drawback of this method consists in that the device must contain a mechanism for carrying out said additional motion.

The invention intends to propose a method of sliver deposition into a flat sliver can permitting to increase the maximum sliver quantity deposited in the flat sliver can while maintaining the simplicity of the deposition procedure.

SUMMARY OF THE INVENTION

The above mentioned drawbacks of the state of art are reduced by the method of depositing the textile fibre sliver into a flat sliver can according to the invention whose principle consists in that the width of the layers of the fibre sliver in the direction perpendicular to the longitudinal axis of the flat sliver can is inferior to the width of the inner space of the flat sliver can thus achieving a deflection of the sliver loop, while being deposited, towards the longitudinal wall of the flat sliver can at which there is a greater speed of the mutual relative motion of the outlet aperture of the can coiler and of the flat sliver can. Preferably, the width of said layer is inferior by 10% to 25% to the width of the inner space of the flat sliver can.

Preferably, after one sliver loop layer has been deposited near one of the longitudinal walls of the flat sliver can during a first direction of the mutual reversing rectilinear motion of the can coiler and of the flat sliver can, the sliver in process of deposition into the loops of the following layer during the opposite direction of the mutual reversing rectilinear motion of the can coiler and of the flat sliver can is exposed to an additional force oriented towards the opposite longitudinal wall of the flat sliver can.

Said additional force can be generated by a lower resistance against the procedure of sliver deposition in the free room next to the no more coaxially deposited loop layer that has been deposited during the preceding direction of the mutual reversing rectilinear motion of the can coiler and of the flat sliver can.

The principle of the device for carrying out said method consists in that the outlet aperture of the can coiler is situated at a distance of 75% to 90% of a half of the width of the inner room of the sliver can from the axis of rotation of the can coiler.

BRIEF DESCRIPTION OF THE DRAWINGS

The examples of embodiment of the invention are shown in the accompanying drawings in which.

DESCRIPTION OF THE INVENTION

The method of depositing a textile fibre sliver into a flat can in which the sliver is deposited in loops produced by the combination of the rotary motion of the outlet aperture of the can coiler and of the mutual reversing rectilinear motion of the can coiler and of the flat sliver can will be explained in more details on two variants of the device suited to carry out the method.

Figure 3:
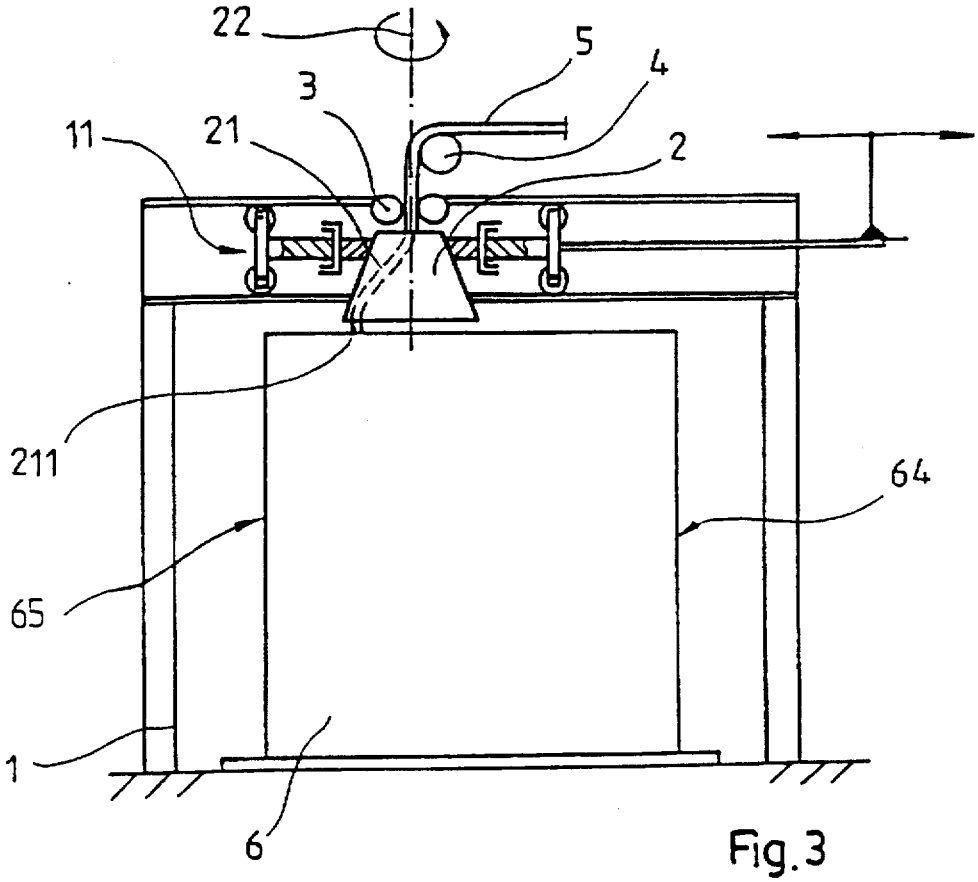
FIG. 3 shows a front view of a first embodiment of the present invention.
Figure 4:
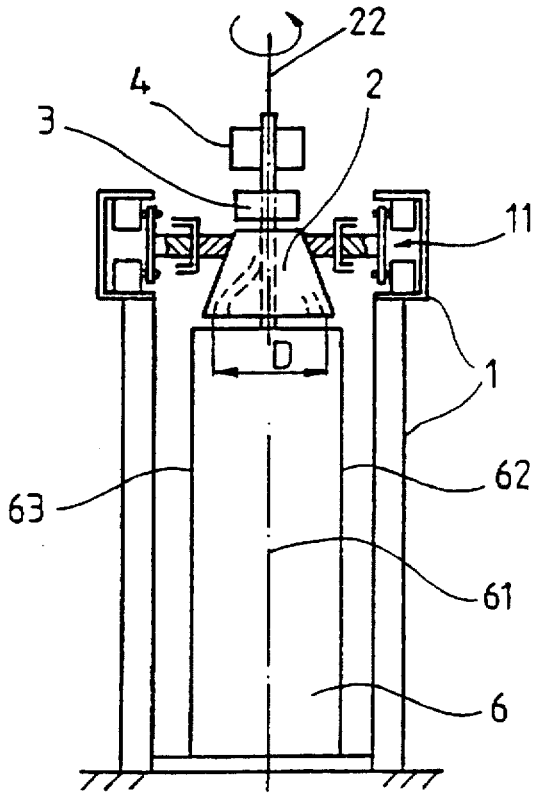
FIG. 4 shows a side view of a first embodiment of the present invention.

The first variant of the device for carrying out the method according to the invention, shown in FIG. 3, comprises a supporting frame 1 having mounted thereon an auxiliary frame 11 adapted for reciprocal motion and carrying a rotatably mounted can coiler 2 over which there are seated on the auxiliary frame 11 feed rollers 3 and an idle roller 4 by which a fibre sliver 5 is led to the feed rollers 3. In the can coiler 2 is provided a depositing channel 21 of the sliver 5 with an outlet aperture 211. In the shown example of this embodiment, the maximum diameter of the circle produced by the rotation of the outlet aperture 211 of the sliver 5 during the revolving movement of the can coiler 2 is by 10% to 25% inferior to the width of the inner space of a flat sliver can 6. In this range have been obtained the best results. However, in some cases, the diameter of said circle can exceed said values, and the greatest possible applicable maximum diameter of the circle produced by the revolving movement of the outlet aperture 211 of the can coiler 2 is by two thirds of the thickness of the sliver inferior to the width of the inner space of the flat sliver can.

During the deposition of the fibre sliver 5, the flat sliver can 6 is seated under the can coiler 2 on its fixed place, and in its longitudinal axis plane 61 travels the rotation axis 22 of the can coiler 2 during its reversing rectilinear motion.

The auxiliary frame 11 is in a well-known way connected with a well-known not represented drive mechanism for receiving the reversing rectilinear motion.

In the process of deposition of the fibre sliver 5 into the flat sliver can 6, the can coiler 2 carries out both the rotary motion around its rotation axis 22 and the reversing rectilinear motion over the fixed in place flat sliver can 6. The reversing rectilinear motion of the can coiler 2 is produced by the reversing motion of the auxiliary frame 11 on the supporting frame 1 actuated by a not shown drive mechanism. Consequently, the rotation axis 22 of the can coiler 2 carries out a rectilinear reversing motion in the direction of the longitudinal axis of the flat sliver can 6, the term "longitudinal axis of the flat sliver can 6" being intended to mean the longitudinal axis of any cross section of the can perpendicular to the side walls of the flat sliver can 6.

The combination of said motions produces loops 51 of the sliver 5 in which the fibre sliver 5 is deposited into flat sliver cans 6. Ideally, the loops have the shape of a cycloid, but in practice, their shape is misformed in one or another way. During the deposition, the fibre sliver gets out of the outlet aperture 211 of the depositing channel 21 of the can coiler 2, and the width of the layer of the loops 51 of the sliver 5 is inferior to the width of the inner space of the flat sliver can 6, in the shown embodiment by 10% to 25%.

Although during the reversing rectilinear motion of the can coiler 2 the rotation axis of the can coiler 2 moves in the longitudinal axis plane of the flat sliver can 6, the loops 51 of the sliver 5 of the layer in process of formation of the loops 51 are deposited asymmetrically with respect to the longitudinal axis plane of the flat sliver can 6; due to forces acting on the sliver 5 in process of deposition inside the flat sliver can 6, the loops 51 are invariably deposited at that of the longitudinal walls of the flat sliver can 6, for instance at the right-side longitudinal wall 62, at which the circumferential velocity of the outlet aperture 211 of the depositing channel 21 of the can coiler 2 is added to the velocity of the rectilinear motion of the can coiler 2 so that the mutual relative velocity of the outlet aperture 211 of the depositing channel 21 of the can coiler 2 and of the flat sliver can 6 is superior to that existing at the opposite longitudinal wall, for instance at the left-side longitudinal wall 63 of the flat sliver can 6.

In the first layers of the loops 51 of the sliver 5 deposited into the flat sliver can 6, the deflection of the layers of the loops 51 of the sliver 5 is produced by the difference of the mutual relative velocity of the outlet aperture 211 of the depositing channel 21 of the can coiler 2 and of the flat sliver can 6 at the longitudinal lateral walls 62, 63 of the flat sliver can 6. In the process of deposition of the subsequent layers is in action an additional force generated by the uneven distribution of the mass of the sliver 5, i.e., of the density with which the fibres of the sliver 5 fill the space, in the cross section of the flat sliver can 6. In places having superior relative velocity of the flat sliver can 6 and of the outlet aperture 211 of the depositing channel 21 of the can coiler 2, also the density of the fibres of the sliver in the cross section of the flat sliver can 6 is superior. The greater said fibre density, the greater is on that place the opposition against the process of depositing another layer of the loops 51 of the sliver 5. Since the can coiler 2 reverts the direction of its reversing rectilinear motion each time it reaches the front or back end point of its travel path, reverted is also the course of the mutual relative velocity of the flat sliver can 6 and of the outlet aperture 211 of the depositing channel 21 of the can coiler 2, so that the following layer of the loops 51 of the sliver 5 will be deflected towards the opposite longitudinal wall of the flat sliver can 6. The deflection is supported by an additional force effect due to the fact that the preceding layer of loops 51 of the fibre sliver has not filled the whole of the inner width of the flat sliver can 6. In the free space next to the layer of the loops 51 of the fibre sliver 5, the smaller filling results in smaller pressure of the material so that the fibre sliver leaving the outlet aperture 211 of the depositing channel 21 of the can coiler 2 tends to deflect into this free space thus helping the fibre silver loop 51 to deflect into the area with greater velocity of the mutual relative motion of the outlet aperture 211 of the depositing channel 21 of the can coiler 2 and the flat sliver can 6. The deflection affects the whole layer of the loops 51 of the fibre sliver 5 deposited during one and the same direction of the motion of the mutual reversing rectilinear motion of the can coiler 2 and of the flat sliver can 6.

This means that the layers of the loops 51 of the fibre sliver 5 deposited into flat sliver cans 6 are not situated symmetrically to the longitudinal axis of the flat sliver can 6 but they are deflected to that of the longitudinal walls of the flat sliver can 6 near which is the area with the greater mutual relative velocity of the outlet aperture 211 of the depositing channel 21 of the can coiler 2 and of the flat sliver can 6. In other words, the layers of the loops 51 of the fibre sliver 5 are deposited in rotation to the opposite longitudinal walls of the flat sliver can 6.

Figure 1:
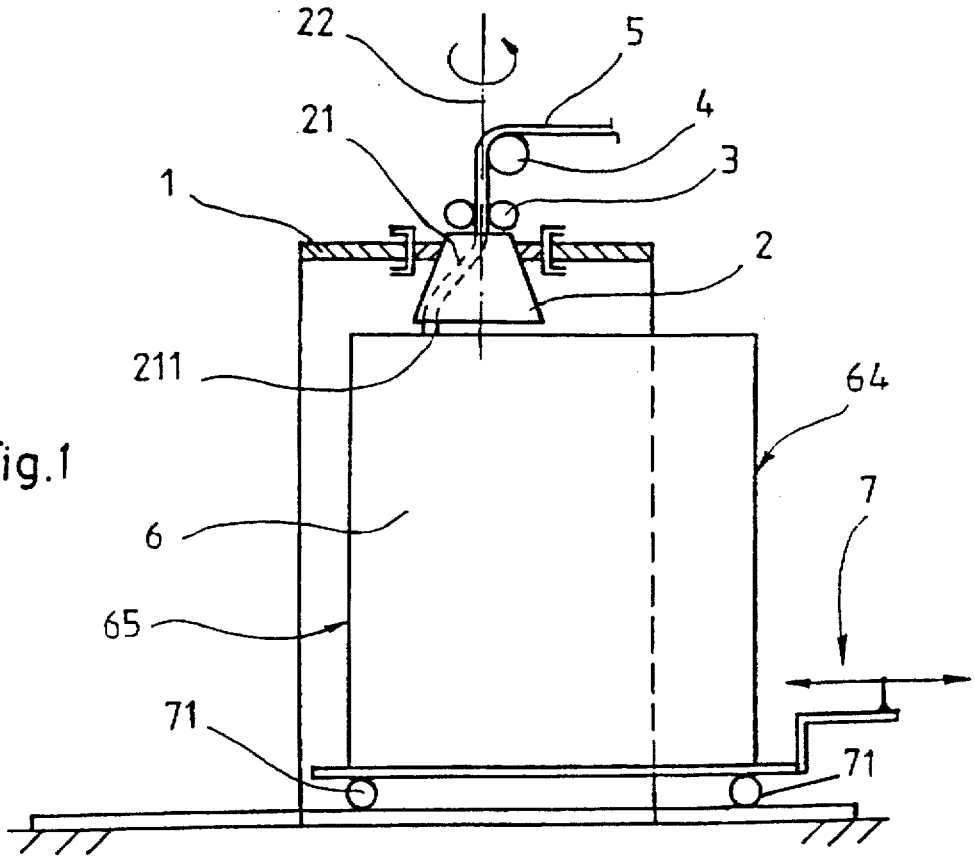
FIG. 1 shows a front view of a second embodiment of the present invention.
Figure 2:
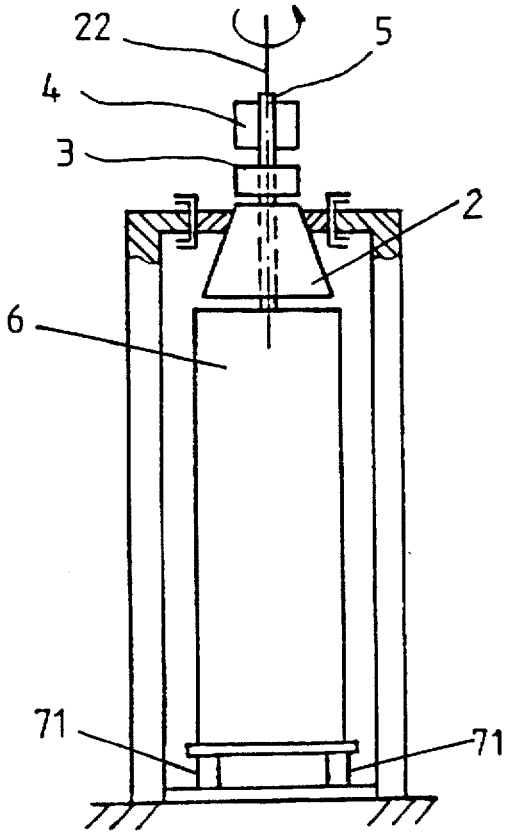
FIG. 2 shows a side view of a second embodiment of the present invention.

The other variant of the device, shown in FIGS. 1 and 2, for depositing a fibre sliver 5 into the flat sliver can 6 contains a supporting frame 1 in which there is in a well-known manner rotatably seated a can coiler 2 connected with a not shown drive mechanism. Over the can coiler 2 are arranged feed rollers 3 between which is led the fibre sliver 5 via an idle roller 4. In the can coiler 2 is provided a depositing channel 21 of the sliver 5 with an outlet aperture 211.

Under the can coiler 2 is situated a flat sliver can 6, adapted to travel reversibly in the direction of its longitudinal axis. In the shown example of embodiment, the cross section of the flat sliver can 6 is a rectangle with rounded corners. The longer sides of the rectangle make the right-side lateral wall 62 and the left-side lateral wall 63 of the flat sliver can 6 while the shorter sides of the rectangle make the front wall 64 and the rear wall 65.

The reversing rectilinear motion of the flat sliver can 6 can be produced by any of the well-known devices used for producing the reversing rectilinear motion, for instance by a carriage carrier 7 of the flat sliver can 6 on which the flat sliver can 6 is fixed while being filled and which is fitted with wheels 71 and connected to a not shown drive mechanism whose moving member carries out the reversible rectilinear motion. The path of one stroke of the rectilinear reversible motion of the flat sliver can 6 is approximately equal to the length of the inner space of the flat sliver can 6 minus double the distance between the outlet aperture 211 of the depositing channel 21 of the can coiler 2 and the rotation axis 22 of the can coiler 2.

In this example of embodiment, the process proper of the fibre sliver 5 deposition into the flat sliver can 6 goes on in the same manner as in the preceding embodiment; the width of the layer of the loops 51 of the sliver 5 is inferior to the width of the inner space of the flat sliver can 6, and the layers following immediately each other are deflected in rotation to one and the other lateral wall 62, 63 of the flat sliver can 6.

The rectangular cross section of the flat sliver can 6 of the above example of embodiment is not obligatory; both the front and the rear wall can be rounded throughout.

The mechanism imparting the flat sliver can 6 the reversing rectilinear motion can consist of a not shown well-known gripping device which grips and lifts the flat sliver can 6 so that the reversing rectilinear motion of the flat sliver can 6 takes place in the lifted position of the flat sliver can 6.

Figure 6:
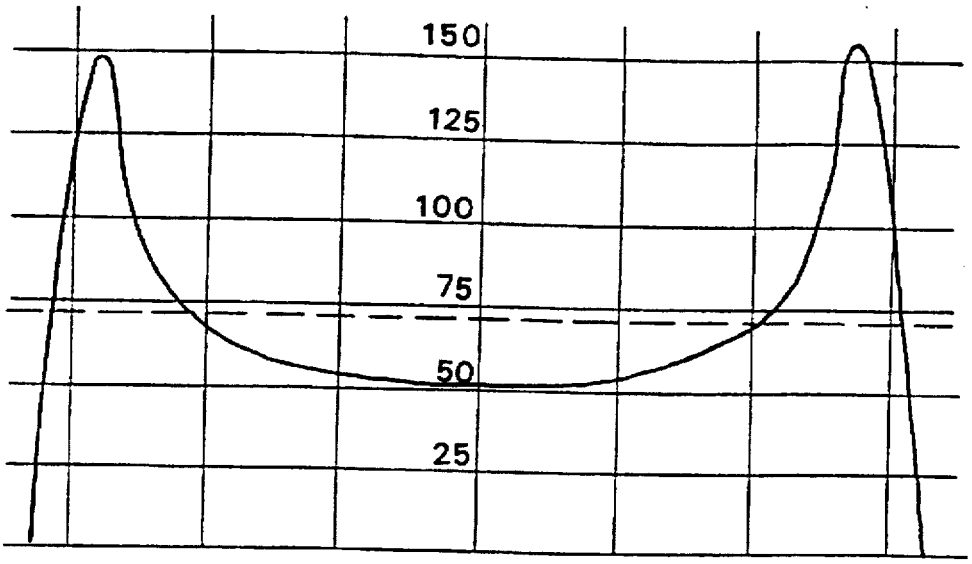
FIG. 6 shows the transverse distribution of the fibre sliver density in the flat sliver can when deposited in one of the methods of the state of art.
Figure 7:
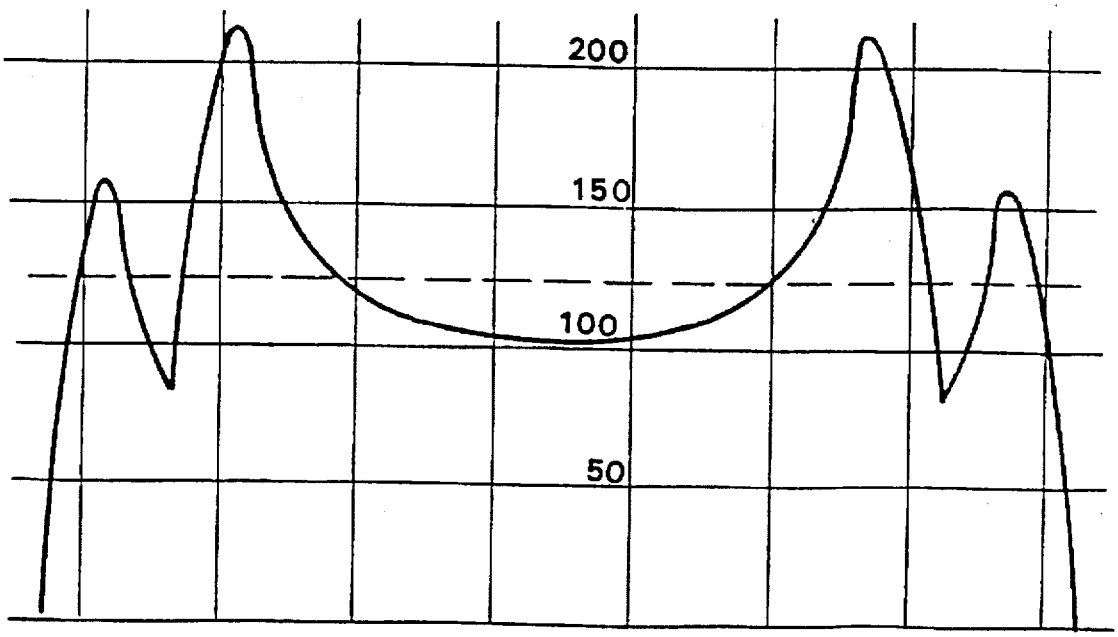
FIG. 7 shows the transverse distribution of the fibre sliver density in the flat sliver can when deposited according to the invention.

FIGS. 6 and 7 are schematic diagrams of the density of the sliver deposited in the flat sliver can 6. More specifically, FIG. 6 shows the deposition of the fibre sliver 5 in one layer of the loops 51 carried out according to one of the methods of the state of art. The density is greatest near the lateral walls 62, 63 of the flat sliver can 6, smallest in the central part of the cross section of the flat sliver can 6, and intermediate in the dashed part.

Figure 5:
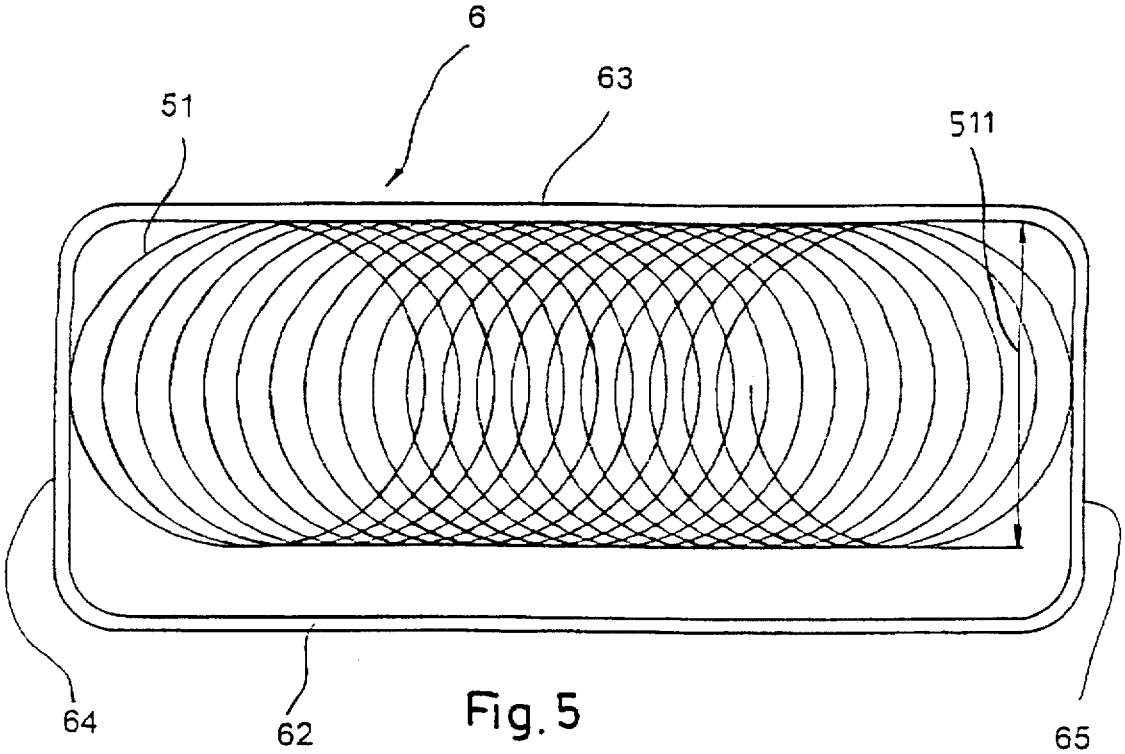
FIG. 5 shows schematically a deposition of a textile fibre sliver in the flat sliver can.
Figure 8:
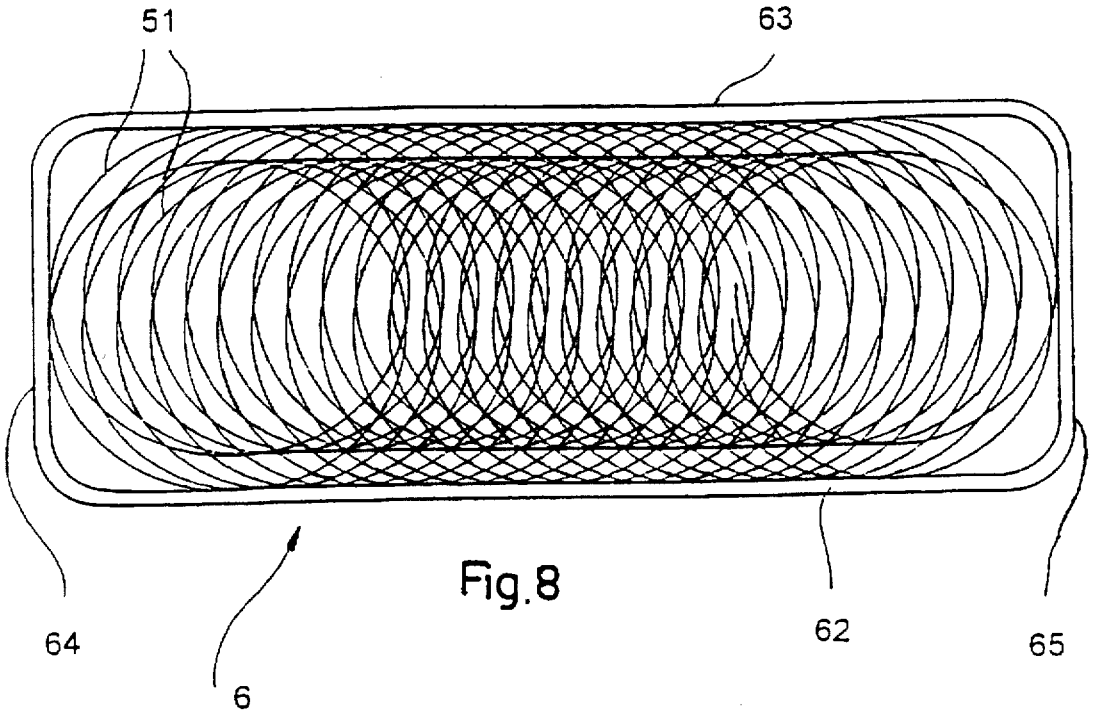
FIG. 8 shows the deposition of two sliver layers in the flat sliver can.

When depositing the fibre sliver 5 according to this invention, the two layers of the loops 51 of the fibre sliver 5 deposited in the flat sliver can 6 immediately after each other are deflected by a value designed in FIG. 5 as u and representing 10% to 25% of the width of the inner space of the flat sliver can 6. With this method of the fibre sliver 5 deposition increase both the area of the greater sliver 5 density near the lateral walls 62, 63 of the flat sliver can 6 and the lowest density in the central part of the can 6, as shown in FIG. 7. The course of the density distribution is symmetrical to the longitudinal axis of the flat sliver can 6 or to its longitudinal axis plane.

I claim:

1. A method of textile fibre sliver deposition into a flat sliver can in which the sliver is being deposited in layered loops produced by the mutually reciprocating rectilinear motion of a rotating can coiler and of the flat sliver can in a direction of a longitudinal axis of the flat sliver can and of a rotary motion of the can coiler, the method comprising the steps of:

depositing the sliver in the flat sliver can with an axis of rotation of the can coiler being continuous in a plane of the longitudinal axis of the flat sliver can;

providing the layered loops of sliver in the flat sliver can with a width, in the direction perpendicular to the longitudinal axis of the flat sliver can, which is less than an interior width of the flat sliver can; and deflecting the layered loops to a longitudinal wall of the flat sliver can, by force generated by the mutual reciprocating rectilinear motion of the rotating can coiler and the flat sliver can, at which a spread of the mutual relative motion of the can coiler and the flat sliver can is greatest.

2. The method as claimed in claim 1, wherein the width of the layered loops is 10% to 25% less than the interior width of the flat sliver can.

3. The method as claimed in claim 1, wherein after one layer of the layered loops of sliver has been deposited near the longitudinal wall of the flat sliver can during a first direction of the mutual reversing rectilinear motion of the can coiler and of the flat sliver can, the sliver in process of deposition into loops (51) of a following layer during the opposite direction of the mutual reversing rectilinear motion of the can coiler and of the flat sliver can is exposed to an additional force oriented towards an opposite longitudinal wall of the flat sliver can.

4. The method as claimed in claim 3, wherein said additional force is generated by a lower resistance against the procedure of sliver deposition in free space next to already deposited layered loops that have been deposited during the preceding direction of the mutual reversing rectilinear motion of the can coiler and of the flat sliver can.

5. An apparatus for depositing a textile fibre sliver, comprising:

a frame;

a can coiler mounted on the frame and adapted for rotation about a rotational axis thereof, the can coiler having a sliver depositing channel and an outlet aperture at an end of the sliver depositing channel;

a flat sliver can mounted under the can coiler, the flat sliver can having a longitudinal axis and an interior width;

a device to provide mutually reciprocating rectilinear motion of the can coiler and of the flat sliver can where the rotational axis of the can coiler continuously moves during the mutually reciprocating rectilinear motion in a plane of the longitudinal axis of the flat sliver can.

6. The apparatus of claim 5, wherein the device to provide the mutually reciprocating rectilinear motion is an auxiliary frame mounted on the frame.

7. The apparatus of claim 5, wherein the flat sliver can is non-circular in its cross-section.

8. The apparatus of claim 5, wherein the outlet aperture is positioned at a distance of about 75% to 90% of half of the interior width of the flat sliver can.

* * * * *